US008080498B2

(12) United States Patent
Shepherd et al.

(10) Patent No.: US 8,080,498 B2
(45) Date of Patent: Dec. 20, 2011

(54) ELASTIC HOLLOW PARTICLES FOR ANNULAR PRESSURE BUILDUP MITIGATION

(75) Inventors: James E. Shepherd, Mason, OH (US); Joseph F. Rakow, San Francisco, CA (US); Phillip David Pattillo, II, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 103 days.

(21) Appl. No.: 12/580,093

(22) Filed: Oct. 15, 2009

(65) Prior Publication Data

US 2010/0113310 A1 May 6, 2010

Related U.S. Application Data

(60) Provisional application No. 61/110,175, filed on Oct. 31, 2008.

(51) Int. Cl.
*C09K 8/60* (2006.01)
*E21B 47/06* (2006.01)

(52) U.S. Cl. ..... 507/219; 166/250.07

(58) Field of Classification Search ..... 507/219; 166/250.07
See application file for complete search history.

(56) References Cited

U.S. PATENT DOCUMENTS

| | | | | |
|---|---|---|---|---|
| 6,508,305 | B1 | 1/2003 | Brannon et al. | |
| 7,096,944 | B2 | 8/2006 | Vargo, Jr. et al. | |
| 7,178,590 | B2 | 2/2007 | Vargo, Jr. et al. | |
| 7,264,053 | B2 | 9/2007 | Vargo, Jr. et al. | |
| 2004/0144537 | A1* | 7/2004 | Reddy et al. | 166/292 |
| 2005/0124499 | A1* | 6/2005 | Shinbach et al. | 507/100 |
| 2005/0194144 | A1 | 9/2005 | Vargo, Jr. et al. | |
| 2006/0213663 | A1* | 9/2006 | Vargo et al. | 166/292 |
| 2006/0231251 | A1* | 10/2006 | Vargo et al. | 166/250.12 |
| 2006/0243435 | A1 | 11/2006 | Faul | |
| 2007/0027036 | A1* | 2/2007 | Polizzotti et al. | 507/143 |
| 2008/0113883 | A1* | 5/2008 | Wang et al. | 507/219 |

FOREIGN PATENT DOCUMENTS

| | | | |
|---|---|---|---|
| WO | 2006/100491 | A1 | 9/2006 |
| WO | 2007/145735 | A2 | 12/2007 |

OTHER PUBLICATIONS

PCT Notification of Transmittal of the International Search Report and the Written Opinion of the International Searching Authority, or the Declaration, issued in related application No. PCT/US2009/060807, mailed Dec. 22, 2010, 12 pages.

* cited by examiner

*Primary Examiner* — Timothy J. Kugel
*Assistant Examiner* — Aiqun Li
(74) *Attorney, Agent, or Firm* — Barbara A. Fisher

(57) ABSTRACT

The concept involves placing within the annulus, hollow particles that possess material and geometric properties such that the hollow particles buckle at or near a defined pressure. Buckling of the particles increases the available volume within the annulus, thereby decreasing the annular pressure. The elastic hollow particles are designed such that they buckle in a sufficiently elastic manner to allow them to rebound towards their original shape as the pressure decreases. The rebounded particles then remain available to mitigate subsequent instances of APB.

20 Claims, 7 Drawing Sheets

ELASTIC HOLLOW PARTICLES FOR ANNULAR PRESSURE BUILDUP MITIGATION

CROSS-REFERENCE TO RELATED APPLICATIONS

This application claims the benefit of U.S. Provisional Application No. 61/110,175, filed Oct. 31, 2008, which is hereby incorporated by reference in its entirety for all purposes.

STATEMENT REGARDING FEDERALLY SPONSORED RESEARCH OR DEVELOPMENT

Not applicable.

BACKGROUND

1. Field of the Invention

This invention relates generally to the field of drilling. More specifically, the invention relates to compositions and methods for annular pressure buildup mitigation.

2. Background of the Invention

Natural resources such as oil or gas residing in a subterranean formation are recovered by drilling a well into the formation. The subterranean formation is usually isolated from other formations using a technique known as well cementing. In particular, a wellbore is typically drilled down to the subterranean formation while circulating a drilling fluid through the wellbore. After the drilling is terminated, a string of pipe (e.g. drill string, casing) is run in the wellbore. Primary cementing is then usually performed where cement slurry is pumped down through the string of pipe and into the annulus between the string of pipe and the walls of the wellbore to allow the cement slurry to set into an impermeable cement column and thereby seal the annulus. Secondary cementing operations may also be performed after the primary cementing operation.

After completion of the cementing operations, production of the oil or gas may commence. The oil and gas are produced at the surface after flowing through the wellbore. As the oil and gas pass through the wellbore, heat may be passed from such fluids through the casing and into the annular space, which typically results in expansion of any fluids in the annular space.

Annular pressure build-up (APB) is a potentially dangerous condition in wells caused by a temperature driven increase in pressure within the annuli formed by downhole strings. APB situations commonly occur in subsea wells, where annuli between adjacent casing strings are sealed from above by wellhead equipment at the mudline and from below by cement tops or barite plugs. Pressure within the annuli is built up as the temperature within the annuli is increased due to the expansion of drilling fluids within the annuli. A significant increase in pressure within the annuli may have adverse consequences such as rupture of the casing wall or catastrophic collapse of the drilling string itself or of the production tubing through which wellbore fluids are brought to surface.

Several techniques for mitigating APB have already been developed and employed with some regularity in the industry. One mitigator, for example, is syntactic foam composed of hollow glass elastic hollow particles with prescribed dimensions. The foam is attached to the outside surface of the inner string of the annulus. Onset of APB above a particular pressure level causes the elastic hollow particles to collapse and break, increasing the available volume of the annulus. These and other commonly used techniques, however, are limited in utility in that they provide only a one-time relief of APB; once activated, the mitigator cannot relieve future instances of pressure buildup.

Consequently, there is a need for more effective compositions and methods for mitigating annular pressure buildup.

BRIEF SUMMARY

The concept involves placing within the annulus, hollow particles that possess material and geometric properties such that the hollow particles buckle at or near a defined pressure. Buckling of the particles increases the available volume within the annulus, thereby decreasing the annular pressure. The elastic hollow particles are designed such that they buckle in a sufficiently elastic manner to allow them to rebound towards their original shape as the pressure decreases. The rebounded particles then remain available to mitigate subsequent instances of APB.

In an embodiment, a method of mitigating annular pressure buildup comprises providing a wellbore composition comprising a plurality of elastic hollow particles. The method further comprises introducing the wellbore composition to an annulus of a wellbore. In addition, the method comprises using the plurality of elastic hollow particles to mitigate annular pressure buildup. The elastic hollow particles buckle above an annular pressure threshold and rebound below the annular pressure threshold.

In another embodiment, a method of mitigating annular pressure buildup comprises providing a wellbore composition comprising a plurality of elliptical hollow particle. The elliptical hollow particles are elastic. The method additionally comprises introducing the wellbore composition to an annulus of a wellbore. Moreover, the method comprises using the plurality of elliptical hollow particles to mitigate annular pressure buildup. The elliptical hollow particles buckle above an annular pressure threshold and rebound below the annular pressure threshold.

In yet another embodiment, a method of mitigating annular pressure buildup comprises providing a wellbore composition comprising a plurality of elastic hollow particles having at least two segments. The method also comprises introducing the wellbore composition to an annulus of a wellbore. In addition, the method comprises using the plurality of elastic hollow particles to mitigate annular pressure buildup. The elastic hollow particles buckle above an annular pressure threshold and rebound below the annular pressure threshold.

The foregoing has outlined rather broadly the features and technical advantages of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

As used herein, the term "elastic" may refer to the ability of a material or particle to resume or return toward its original shape after compression or deformation.

DETAILED DESCRIPTION OF THE PREFERRED EMBODIMENTS

Figure 1:
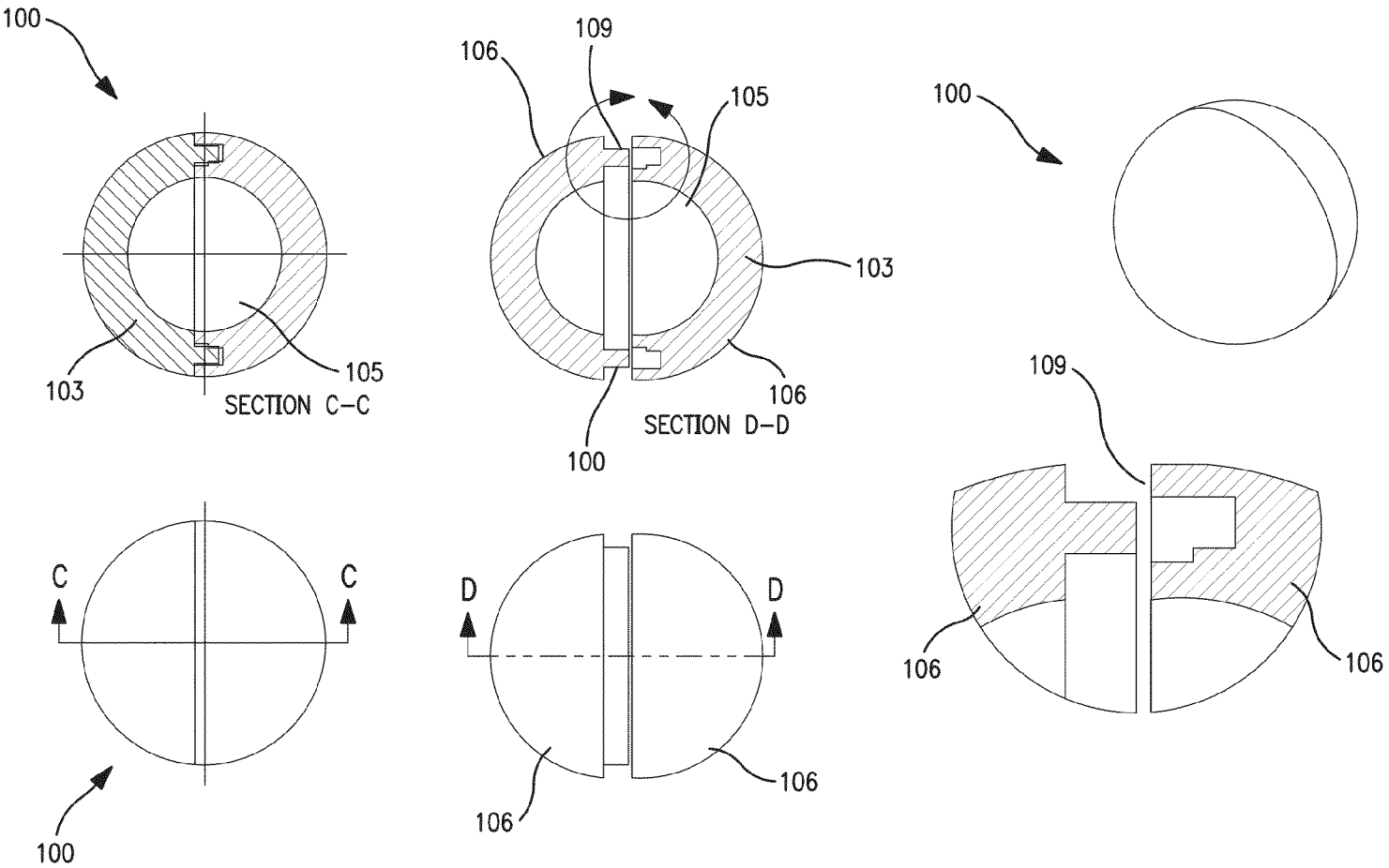
FIG. 1 illustrates an embodiment of an elastic hollow particle which may be used with the disclosed methods.

In general, embodiments of the disclosed methods for mitigating annular pressure buildup utilize a wellbore composition comprising a plurality of elastic hollow particles. FIG. 1 illustrates an embodiment of an elastic hollow particle 100 which may be used in the wellbore composition. In an embodiment, the elastic hollow particle 100 comprises a shell 103 of elastic polymeric material and an inner hollow cavity 105. The plurality of elastic hollow particles 100 may be mixed with an existing wellbore fluid and injected into the annulus of a wellbore. In instances of annular pressure buildup, the elastic hollow particles 100 may buckle to alleviate the pressure within the annulus and effectively provide more volume within the annulus. Once the temperature within the annulus has been decreased and the APB as been reduced, elastic hollow particles 100 are capable of rebounding to their original shape and are, thus, re-usable for subsequent instances of APB. By comparison, existing particles and APB mitigators only provide for one time mitigation of APB.

Figure 2B:
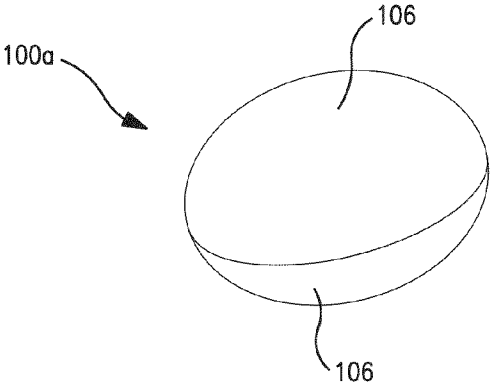
FIG. 2 illustrates an elliptical embodiment of an elastic hollow particle which may be used with the disclosed methods.
Figure 2D:
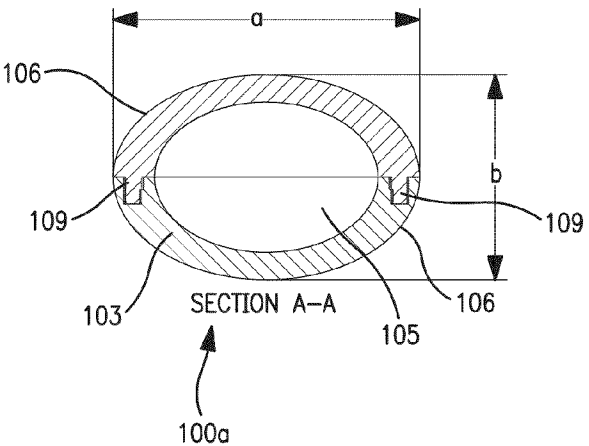
Figure 2A:
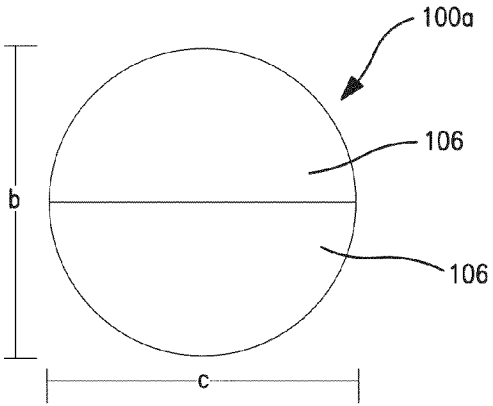
Figure 2C:
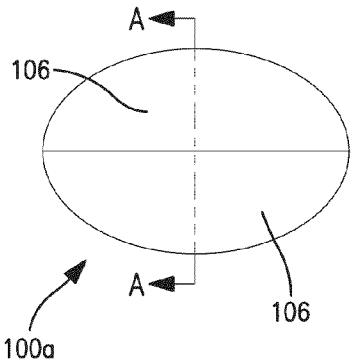

Elastic hollow particle 100 may be any suitable shape. In an embodiment, elastic hollow particle 100 may have a spherical shape. FIG. 1 shows an example of such an embodiment of elastic hollow particle with an outer spherical shape. In other embodiments, elastic hollow particle 100 may comprise variations of a sphere such as without limitation, prolate spheroid, oblate spheroid, spheres, ovoids (i.e. egg shaped), etc, such as depicted in FIG. 2. In other words, elastic hollow particle 100 may comprise an elliptical hollow particle 100*a*. Referring to FIG. 2D, elliptical hollow particle 100*a* may have a semi-major axis, a, and a semi-minor axis, b. Axes a and b may be of any suitable length. More particularly, axis a may have a length ranging from about 50 mm to about 0.1 mm, alternatively from about 25 mm to about 2 mm, alternatively from about 5 mm to about 1 mm. Axis b may have a length ranging from about 50 mm to about 0.1 mm, alternatively from about 25 mm to about 2 mm, alternatively from about 5 mm to about 1 mm. In addition, axes a and b may be of any suitable ratio to each other. Referring to FIG. 2A, in an embodiment, elliptical hollow particle 100*a* may have a circular cross-section (i.e. prolate spheroid). However, it is contemplated that elliptical hollow particle 100*a* may also have an elliptical cross-section (i.e. oblate spheroid). As such, axes b and c in FIG. 2A may be different from one another and may be of any suitable ratio to one another. Axis c may be of any length. More particularly, axis c may have a length ranging from about 50 mm to about 0.1 mm, alternatively from about 25 mm to about 2 mm, alternatively from about 5 mm to about 1 mm.

Inner cavity 105 if elastic hollow particle 100 may be filled with any suitable fluid or material (e.g. gas, liquid, foam) at a range of pressures (atmospheric or higher). Examples of suitable fluids include without limitation, air, inert gas, or combinations thereof. Inner cavity 105 of elastic hollow particle 100 may have the same geometry or a different geometry than that of the shell 103. For example, shell 103 may comprise a spherical geometry while inner cavity may have a prolate spheriodal geometry.

Furthermore, in some embodiments, elastic hollow particles 100 may comprise at least two segments 106. That is, the elastic hollow particles 100 are segmented hollow particles. The elastic hollow particles 100 may be fabricated from any number of segments 106. In one embodiment, elastic hollow particles have two segments 106. The segments 106 may fit together via a snap-fit connection 109 or other suitable connection, such as for example, welding. Inner cavity 103 may be filled with any suitable fluid or material (e.g. gas, liquid, foam) at a range of pressures (atmospheric or higher). Examples of suitable fluids include without limitation, air, inert gas, or combinations thereof. Inner cavity 105 of elastic hollow particle 100 may have the same geometry or a different geometry than that of the shell 103. For example, shell 103 may comprise a spherical geometry while inner cavity may have a prolate spheroidal geometry.

Elastic hollow particles 100 may be manufactured by any methods known to those of skill in the art. In one embodiment, elastic hollow particles 100 may be made by injection molding.

As mentioned above, shell 103 of elastic hollow particle 100 preferably comprises an elastic polymeric material. However, shell 103 may comprise any suitable material which exhibits the requisite elastic properties for mitigating annular pressure buildup. Examples of suitable polymeric materials include without limitation, polybutadiene, ethylene propylene diene (EPDM) rubber, silicone, polyurethane, polyamide, acetal, thermoplastic elastomers, polypropylene, polyethylene, polytetrafluoroethylene (PTFE), polyvinylidenefluoride (PVDF), or combinations thereof. The elastic polymeric material may be a copolymer, a random copolymer, a block copolymer, a multiblock copolymer, a polymer blend, or combinations thereof.

The elastic hollow particles 100 may have any suitable diameter. More specifically, embodiments of the elastic hollow particles 100 may have an average outer diameter ranging from about 50 mm to about 0.1 mm, alternatively from about 25 mm to about 2 mm, alternatively from about 5 mm to about 1 mm. Additionally, elastic hollow particles 100 may have any suitable shell thicknesses. In particular, embodiments of the elastic hollow particles may have an average shell thickness ranging from about 10 mm to about 5 mm, alternatively from about 5mm to about 1 mm, alternatively from about 1 mm to about 0.1 mm. Inner cavity 105 of elastic hollow particle 100 may have any suitable diameter. For example, inner cavity 105 may have an average diameter ranging from about 50 mm to about 25 mm, alternatively from about 25 mm to about 5 mm, alternatively from about 5 mm to about 0.1 mm.

In embodiments, the elastic hollow particles 100 have very specific mechanical properties in order to properly mitigate annular pressure buildup. In particular, elastic hollow particles 100 may have an elastic modulus at 25° C. ranging from about 100 GPa to about 10 MPa, alternatively from about 1 GPa to about 100 MPa, alternatively from about 100 MPa to about 10 MPa. Furthermore, elastic hollow particles 100 may have a yield strain at about 25° C. ranging from about 100% to about 50%, alternatively from about 50% to about 10%, alternatively from about 10% to about 1%. In other words, the elastic hollow particles 100 may be designed to buckle at a specific annular pressure and/or temperature. As used herein, "annular pressure threshold" is the pressure within the annulus for which the elastic hollow particles 100 may be designed to compress or buckle at a given temperature. Accordingly, the elastic hollow particles 100 may buckle or compress at an annular pressure threshold ranging from about 15,000 psi to about 10,000 psi, alternatively from about 10,000 psi to about 5,000 psi, alternatively from about 5,000 psi to about 500 psi.

In addition, elastic hollow particles 100 provide greater volume compression than solid particles. Accordingly, each elastic hollow particle 100 may compress to an average volume ranging from about 99% to about 50% of its original volume, alternatively from about 50% to about 10% of its original volume, alternatively from about 10% to about 1% of its original volume. With respect to elasticity, the elastic hollow particles 100 preferably rebound or return to at least about 99% of their original volume, alternatively at least about 50% of their original volume, alternatively at least about 10% of their original volume.

The elastic hollow particles 100 may be used in conjunction with any wellbore composition and/or fluids known to those of skill in the art. Examples of known wellbore fluids include without limitation, production fluids, drilling muds, spacer fluids, chemical pills, completion fluids, or combinations thereof. As such, the elastic hollow particles 100 may be present in a fluid composition at a concentration ranging from about 70 vol % to about 25 vol %, alternatively from about 25 vol % to about 1 vol %.

The wellbore composition may include additional fluids and additives commonly used in existing wellbore treatment fluids. In particular, the wellbore composition may comprise an aqueous-based fluid or a nonaqueous-based fluid. Without limitation, examples of suitable aqueous-based fluids include fresh water, salt water (e.g., water containing one or more salts dissolved therein), brine (e.g., saturated salt water), seawater, water-based drilling fluids (e.g., water-based drilling fluid comprising additives such as clay additives), and combinations thereof. Examples of suitable nonaqueous-based fluids include without limitation, diesel, crude oil, kerosene, aromatic mineral oils, non-aromatic mineral oils, linear alpha olefins, poly alpha olefins, internal or isomerized olefins, linear alpha benzene, esters, ethers, linear paraffins, or combinations thereof. For instance, the non-aqueous-based fluids may be blends such as internal olefin and ester blends. In some embodiments, the additional fluids and/or additives may be present in the wellbore composition in an amount sufficient to form a pumpable wellbore fluid.

The elastic hollow particles 100 may be placed in a subterranean annulus in any suitable fashion. For example, the elastic hollow particles 100 may be placed into the annulus directly from the surface. Alternatively, the elastic hollow particles 100 may be flowed into a wellbore as part of a wellbore composition via the casing and permitted to circulate into place in the annulus between the casing and the subterranean formation. Generally, an operator will circulate one or more additional fluids (e.g., a cement composition) into place within the subterranean annulus behind the well fluids of the present invention therein; in certain exemplary embodiments, the additional fluids do not mix with the well fluids of the present invention. At least a portion of the well fluids of the present invention then may become trapped within the subterranean annulus; in certain exemplary embodiments of the present invention, the well fluids of the present invention may become trapped at a point in time after a cement composition has been circulated into a desired position within the annulus to the operator's satisfaction. At least a portion of the elastic hollow particles 100 may collapse or reduce in volume so as to affect the pressure in the annulus. For example, if the temperature in the annulus should increase after the onset of hydrocarbon production from the subterranean formation, at least a portion of the hollow particles 100 may collapse or reduce in volume so as to desirably mitigate, or prevent, an undesirable buildup of pressure within the annulus.

To further illustrate various illustrative embodiments of the present invention, the following examples are provided.

EXAMPLE 1

A variety of industries and materials suppliers were surveyed to locate readily available, off-the-shelf hollow polymer particles. The search criteria were limited to the following: the particles had to be hollow and made of plastic or rubber, with an outside diameter of no more than 10 mm. While the downhole operating requirements are much more stringent, these relatively simple criteria allowed acquisition of particles that could serve as potential concept demonstrators.

After considering a variety of experimental techniques for applying elevated pressures on the order of 15,000 psi and measuring changes in volume demonstrated by the elastic hollow particles, a High Pressure Pump Model 68-5.75-15 from High Pressure Equipment (HiP) was acquired. This device is a manual screw-driven pressure generator that is capable of applying pressures up to 15,000 psi in a small cylindrical chamber approximately 16 inches long and 11/16 inch in diameter. For each experiment, the test chamber was filled with a mixture of water and elastic hollow particles and care was taken to minimize the amount of air remaining in the chamber. A digital pressure gauge measured the pressure applied to the test samples, while a linear voltage displacement transducer (LVDT) on the drive screw measured the applied volume change.

EXAMPLE 2

Figure 3:
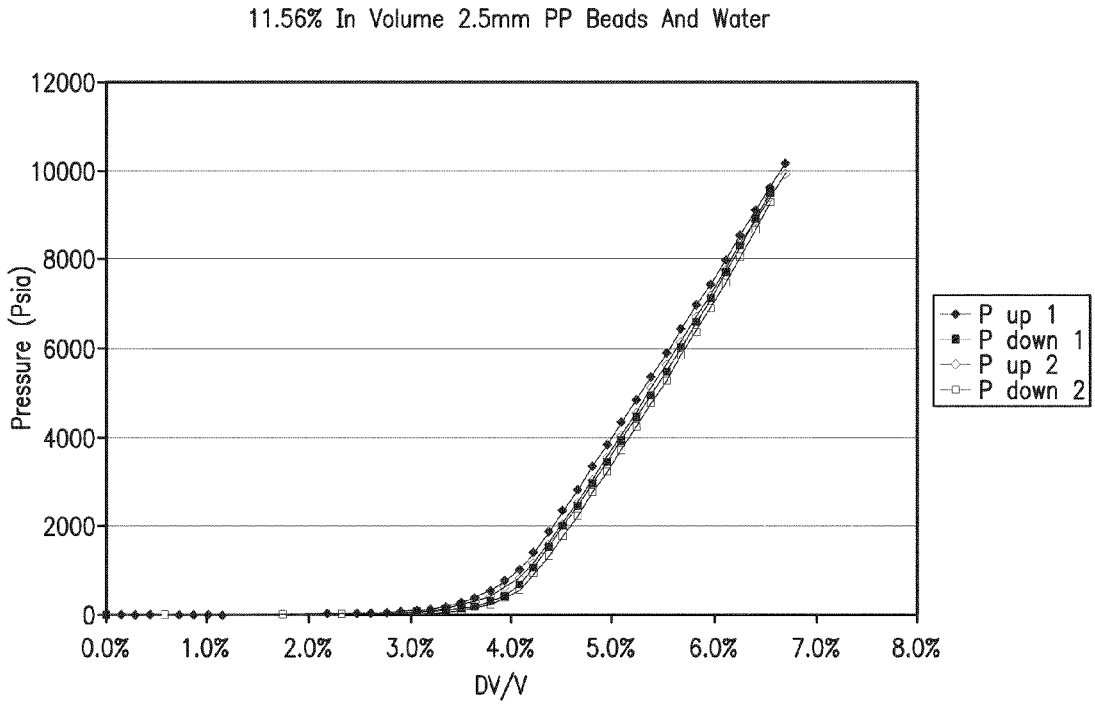
FIG. 3 illustrates a pressure-volume curve for the compression of water and a sample of polypropylene elastic hollow particles.

This experiment involved two pressure cycles up to 10,000 psi of an 11.6% mixture in volume of a sample of polypropylene hollow particles (Sample 1) and water. The elastic hollow particles used for this experiment had an outside diameter of 2.5 mm and a variable size cavity. Microscopic exploration revealed that the size of the cavity was minimal. As a result, the pressure-volume curve (as shown in FIG. 3) was very similar to that obtained in an experiment involving only the compression of water and residual air.

EXAMPLE 3

Figure 4:
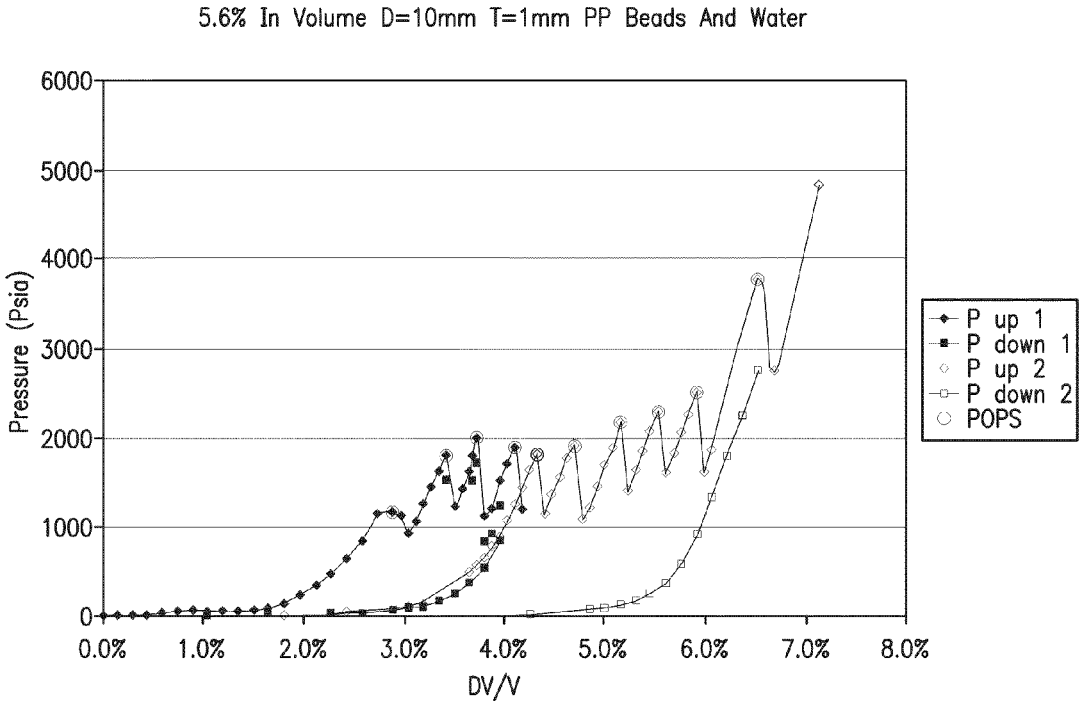
FIG. 4 illustrates a pressure-volume curve for the compression of water and another sample of polypropylene elastic hollow particles.

This experiment involved two pressure cycles of a 5.6% mixture in volume of another sample of polypropylene elastic hollow particles (Sample 2) and water. Results are shown in FIG. 4. The polypropylene elastic hollow particles had a 10 mm diameter and a 1 mm wall thickness. The sound of the elastic hollow particles collapsing could be heard under the increasing pressure. As seen in the pressure-volume response, every collapsed particle provided additional volume and relieved the pressure in the chamber. Most of the elastic hollow particles, with the exception of two, failed close to 2,000 psi. The failure mode representative of all ten elastic hollow particles is shown in FIG. 3.

The maximum pressure did not significantly exceed 2,000 psi until collapse of the final particle, which occurred at about 6.5% change in volume. This location on the plot is about 5% change in volume above the point at which the pressure first began to depart from 0 psi (1.5%). This value of 5% change in volume can be compared to the results of the experiment involving only water a residual air. In that experiment, the pressure exceeded 2,000 psi at about 4.5% change in volume, which is about 1.5% change in volume above the point at which the pressure first began to depart from 0 psi. These results show that collapse of the elastic hollow particles provided additional volume and prevented the pressure from increasing. Only when all elastic hollow particles were collapsed did the pressure increase dramatically. Selection of appropriate material and geometry for the elastic hollow particles could make this pressure relief available on a repeatable basis.

EXAMPLE 4

Figure 5:
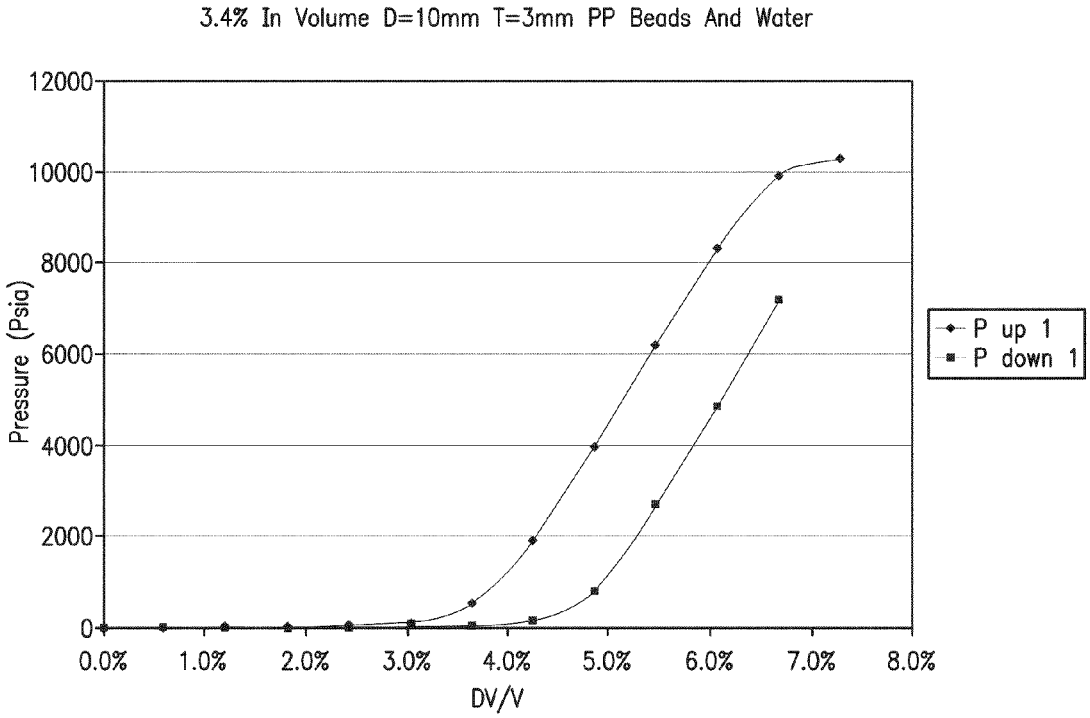
FIG. 5 illustrates a pressure-volume curve for the compression of water and another sample of polypropylene elastic hollow particles.

The fourth experiment involved a single pressure cycle of a 3.4% volume fraction mixture of another sample of polypropylene elastic hollow particles (Sample 4) and water. The elastic hollow particles in this sample had a diameter of 10 mm and a wall thickness of 3 mm. The results are shown in FIG. 5. As shown, the elastic hollow particles exhibited pressure relief at approximately 10,000 psi. The slope of the pressure-volume curve decreased in a gradual fashion as the elastic hollow particles collapsed. At the conclusion of the experiment, the chamber was opened and the elastic hollow particles were observed to be undeformed, indicating that the elastic hollow particles had collapsed elastically.

Hysteresis in the first cycle indicated viscoelastic material behavior of the elastic hollow particles; deformation during the first cycle likely changed the material stiffness. In this respect, the first cycle likely "pre-conditioned" the hollow particles. It is expected that collapse during the second cycle would demonstrate behavior differing from that shown in the first cycle, yet would be repeatable in cycles beyond the second cycle. An issue with instrumentation caused this particular experiment to be terminated before the second cycle could be completed. Further experimentation with these hollow particles, particularly involving multiple pressure cycles, is necessary to confirm the above observations and to further understand the potential for pressure relief provided by these elastic particles.

EXAMPLE 5

Figure 6:
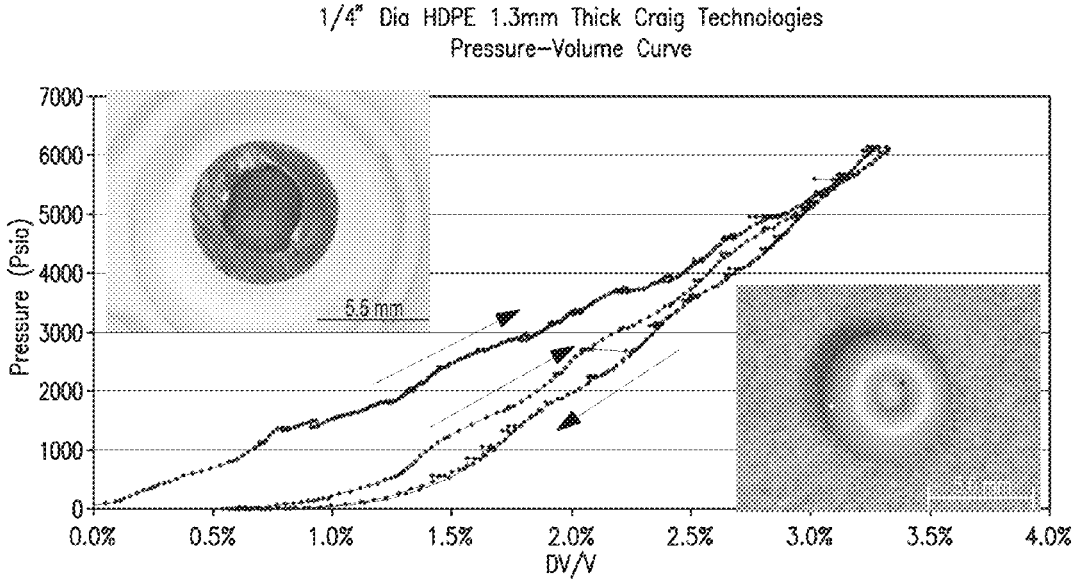
FIG. 6 illustrates a pressure-volume curve for the compression of water and a sample of high-density polyethylene elastic hollow particles.
Figure 7:
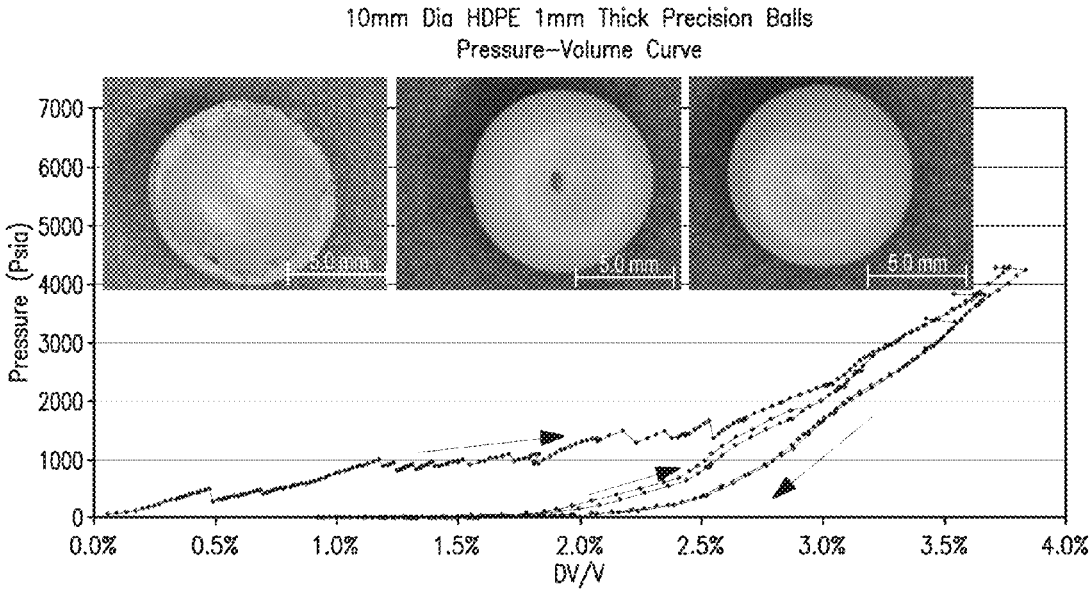
FIG. 7 illustrates a pressure-volume curve for the compression of water and another sample of high-density polyethylene elastic hollow particles.

FIGS. 6 and 7 show the results of pressure-volume experiments performed with samples of elastic hollow particles fabricated with high-density polyethylene (HDPE). FIG. 6 shows results using HDPE elastic hollow particles with outer diameter of 0.25 inches and a shell thickness of 1.3 mm. FIG. 7 shows the results using HDPE elastic hollow particles with outer diameter of 10 mm and a shell thickness of 1 mm. These results provide further proof of concept that elastic hollow particles with different types of polymers may be applied to APB mitigation.

While the embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The discussion of a reference is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A method of mitigating annular pressure buildup comprising:

a) providing a wellbore composition comprising a plurality of elastic hollow particles, wherein the elastic hollow particles are segmented;

b) introducing the wellbore composition to an annulus of a wellbore; and c) using the plurality of elastic hollow particles to mitigate annular pressure buildup, wherein the elastic hollow particles buckle above an annular pressure threshold to as low as about 1% of their original volume and rebound below the annular pressure threshold to as high as about 99% of their original volume.

2. The method of claim 1 wherein each elastic hollow particle comprises a shell and an inner cavity.

3. The method of claim 2 wherein the shell has a thickness ranging from about 10 mm to about 0.1 mm.

4. The method of claim 2 wherein the inner cavity has a diameter ranging from about 50 mm to about 0.1 mm.

5. The method of claim 1 wherein the plurality of elastic hollow particles has an average outer diameter ranging from about 50 mm to about 1 mm.

6. The method of claim 1 wherein the plurality of elastic hollow particles comprises a polymeric material.

7. The method of claim 6 wherein the polymeric material comprises polybutadiene, ethylene propylene diene (EPDM) rubber, silicone, polyurethane, polyamide, acetal, thermoplastic elastomers, polypropylene, polyethylene, polytetrafluoroethylene (PTFE), polyvinylidenefluoride (PVDF), or combinations thereof.

8. The method of claim 1 wherein the elastic hollow particles comprises a polyamide.

9. The method of claim 1 wherein the annular pressure threshold ranges from about 15,000 psi to about 500 psi.

10. The method of claim 1 wherein the elastic hollow particles are prolate spheroids, oblate spheroids, spheres, ovoids, or combinations thereof.

11. The method of claim 1 wherein the elastic hollow particles have an elastic modulus ranging from about 10 GPa to about 10 MPa.

12. The method of claim 1 wherein the elastic hollow particles have a yield strain ranging from about 100% to about 1%.

13. The method of claim 1 wherein the wellbore composition further comprises a fluid, an additive, or compositions thereof

14. The method of claim 13 wherein the fluid comprises diesel, crude oil, kerosene, aromatic mineral oils, non-aromatic mineral oils, linear alpha olefins, poly alpha olefins, internal or isomerized olefins, linear alpha benzene, esters, ethers, linear paraffins, or combinations thereof.

15. The method of claim 13 wherein the fluid comprises a drilling fluid, a completion fluid, a spacer fluid, or combinations thereof.

16. The method of claim 1 wherein the elastic hollow particles are present in a fluid composition at a concentration ranging from about 70 vol % to about 1 vol %.

17. A method of mitigating annular pressure buildup comprising:

a) providing a wellbore composition comprising a plurality of elliptical hollow particles, wherein the elliptical hollow particles are elastic, and wherein each of the elliptical hollow particles comprise at least two segments;

b) introducing the wellbore composition to an annulus of a wellbore; and c) using the plurality of elliptical hollow particles to mitigate annular pressure buildup, wherein the elliptical hollow particles buckle above an annular pressure threshold to as low as about 1% of their original volume and rebound below the annular pressure threshold to as high as about 99% of their original volume.

18. A method of mitigating annular pressure buildup comprising:

a) providing a wellbore composition comprising a plurality of elastic hollow particles, each particle having at least two segments;

b) introducing the wellbore composition to an annulus of a wellbore; and c) using the plurality of elastic hollow particles to mitigate annular pressure buildup, wherein the elastic hollow particles buckle above an annular pressure threshold and rebound below the annular pressure threshold.

19. The method of claim 18 wherein the elastic hollow particles are prolate spheroids, oblate spheroids, ovoids, spheres, or combinations thereof

20. The method of claim 18 wherein the at least two segments are coupled by a welded connection, a snap-fit connection, or combinations thereof.

* * * * *